United States Patent [19]

Schlick

[11] Patent Number: 4,970,830

[45] Date of Patent: Nov. 20, 1990

[54] APPARATUS FOR THE UNIFORM DOSAGE OF GRANULAR BLASTING AGENTS IN PNEUMATICAL BLASTING MACHINES

[75] Inventor: Horst-Dieter Schlick, Metelen, Fed. Rep. of Germany

[73] Assignee: Schlick-Roto-Jet Maschinenbau GmbH, Metelen, Fed. Rep. of Germany

[21] Appl. No.: 265,787

[22] Filed: Nov. 1, 1988

Related U.S. Application Data

[63] Continuation-in-part of Ser. No. 68,920, Jul. 1, 1987, abandoned.

[51] Int. Cl.[5] ..... B24C 7/00

[52] U.S. Cl. ..... 51/436; 406/136; 222/630; 51/437

[58] Field of Search ..... 51/436, 437, 410, 292, 51/263; 406/136; 222/236, 242, 410, 630

[56] References Cited

U.S. PATENT DOCUMENTS 4,048,757 9/1977 Kubus ..... 51/436

FOREIGN PATENT DOCUMENTS 160779 11/1903 Fed. Rep. of Germany .
225021 4/1909 Fed. Rep. of Germany .
430112 6/1924 Fed. Rep. of Germany .
572634 9/1929 Fed. Rep. of Germany .
2843209 10/1978 Fed. Rep. of Germany .
3131002 8/1981 Fed. Rep. of Germany .
0026724 2/1983 Japan ..... 406/136
57820 10/1911 Switzerland .
243418 1/1947 Switzerland .
0829523 5/1981 U.S.S.R. ..... 406/136
2128911 5/1984 United Kingdom ..... 51/436

*Primary Examiner*—Frederick R. Schmidt
*Assistant Examiner*—Blynn Shideler
*Attorney, Agent, or Firm*—Felfe & Lynch

[57] ABSTRACT

An apparatus for the uniform proportioning of granular blasting agents in pneumatically operating blasting machines is disclosed in which the blasting agent supply is in a closed hopper with a blasting agent feed controlled with regard to the amount of agent fed per unit of time. A screw conveyor screw disposed in a horizontal screw conveyor tube having an entry area adjacent to the discharge area, which is in turn adjacent to a removal duct of the conveyor screw tube has substantially the same cross section diameter value of a blast-air duct. The blast-air duct forms a tee with the screw tube in the discharge area. To compensate for the pressure drop in the device during its operation, a connecting duct is provided between the blast-air duct and the closed hopper. The branching of the connecting duct to the blast-air duct lies upstream from the entrance to the screw conveyor tube.

8 Claims, 1 Drawing Sheet

APPARATUS FOR THE UNIFORM DOSAGE OF GRANULAR BLASTING AGENTS IN PNEUMATICAL BLASTING MACHINES

This application is a continuation-in-part of application Ser. No. 068,920, filed July 1, 1987 now abandoned.

FIELD OF THE INVENTION

This invention concerns an apparatus for the uniform dosage of granular blasting agents in pneumatically operating blasting machines. The blasting agent supply is contained in a closed hopper, which has a blasting agent feed that can be controlled with regard to the amount of agent fed per unit time by means of a conveyor screw disposed in a horizontal screw conveyor tube which has an entry area adjoining the removal duct.

BACKGROUND OF THE INVENTION

A pneumatical blasting machine is disclosed in DE-A No. 225,021. FIGS. 1 and 2 of the disclosure show embodiments of such an apparatus in which an air stream is either used in the blast-air duct as an additional transport means or an allowance is made for it. In the first embodiment, the air stream, runs in the screw shaft itself causing a strong entraining effect at the end of the spiral, which leads to disturbances and irregularity in starting up the apparatus. In the second embodiment, the shaft of the screw is also an air carrying means. It contains additional side channels which run into the screw conveyor tube and entrain the blasting agent. In this embodiment as well turbulence, air shocks and other such phenomena will result creating irregularities in the operation of the device, especially when the apparatus is started up and shut down.

Conveyor screws which operate in a conveyor tube are generally known and installed in many technical apparatus. Precise studies have been made of their conveying characteristics, screw pitch, output, and the like, so that either by a few experiments or on the basis of manufacturer's instructions and tables, it is possible to establish the accurate output of a conveyor screw with reference to a particular blasting agent. See, for example, the proposals for calculations made by FISCHER in HUETTE II B.

It was surprisingly found that the device according to the present invention solved a difficult problem of achieving constant and reproducible blasting agent flow rates by, in part, providing a conveyor screw with a stepless rotatory speed which can be finely adjustable to achieve precise rates of feed with exact reproduction. In addition, any pressure drop that may exist between the air pressure in the discharge area of the screw conveyor tube and the air pressure in the blast-air duct can be eliminated. This means of achieving air pressure equalization between the tube discharge and the blast air duct is not taught in the prior art apparatus, since compressed air in the known devices generally provides for an overpressure in the hopper and serves to force out the blasting agent. The hopper pressure must therefore generally be higher than the back pressure in the blasting agent feed in the know devices.

Lastly, it is also important to prevent undesired suction or pressure effects from occurring in pneumatic blasting devices, which result from Bernouilli's law This law of aerodynamics states that in a flow of incompressible fluid the sum of the static pressure and the dynamic pressure along a streamline is constant, if gravity and frictional effects are disregarded. It thus follows that where there is a velocity increase in a fluid flow, there must be a corresponding pressure decrease.

Particularly in the case of so-called suction jets, an injector nozzle is provided in the blasting agent delivery hose which produces a vacuum. Thus, shocks, gas bubbles and the like can occur, resulting in the unbalancing of the blasting agent stream. An apparatus of the kind described, in DE-A No. 160,779 does not disclose a means for eliminating such disturbances.

SUMMARY OF THE INVENTION

It is an object of this invention to employ a mechanical means to maintain the constant feeding of granular blasting agents in pneumatically operating blasting machines over long periods of time. That is to maintain a measured amount of agent fed in a short time unit (e.g. per second) constant over long time units (e.g. per hour).

It is another object to make this feed rate reproducible, that is, to maintain the same feed rate for the same blasting agent after the blasting machine has been shut down and then restarted. The same feed rate must also be substantially maintained from the time the machine is started up and the time it is shut down.

These objects and others which will be obvious to those skilled in the art are achieved in the inventive pneumatical blasting machine which has a screw conveyor tube with an entry area adjoining a discharge area, which in turn runs into a blast-air duct. The screw conveyor tube and blast air duct have substantially the same cross-section diameter value and the blast-air duct forms a T junction with the screw conveyor tube in the discharge area. Additionally, a connecting duct is provided between the blast-air duct and the closed hopper to compensate for a drop in pressure due to the flow of the blasting agent in the apparatus. The connecting duct is connected to the blast-air tube by a branch of the duct positioned upstream from the entrance of the screw conveyor tube.

DETAILED DESCRIPTION OF THE PREFERRED EMBODIMENT

Figure 1:
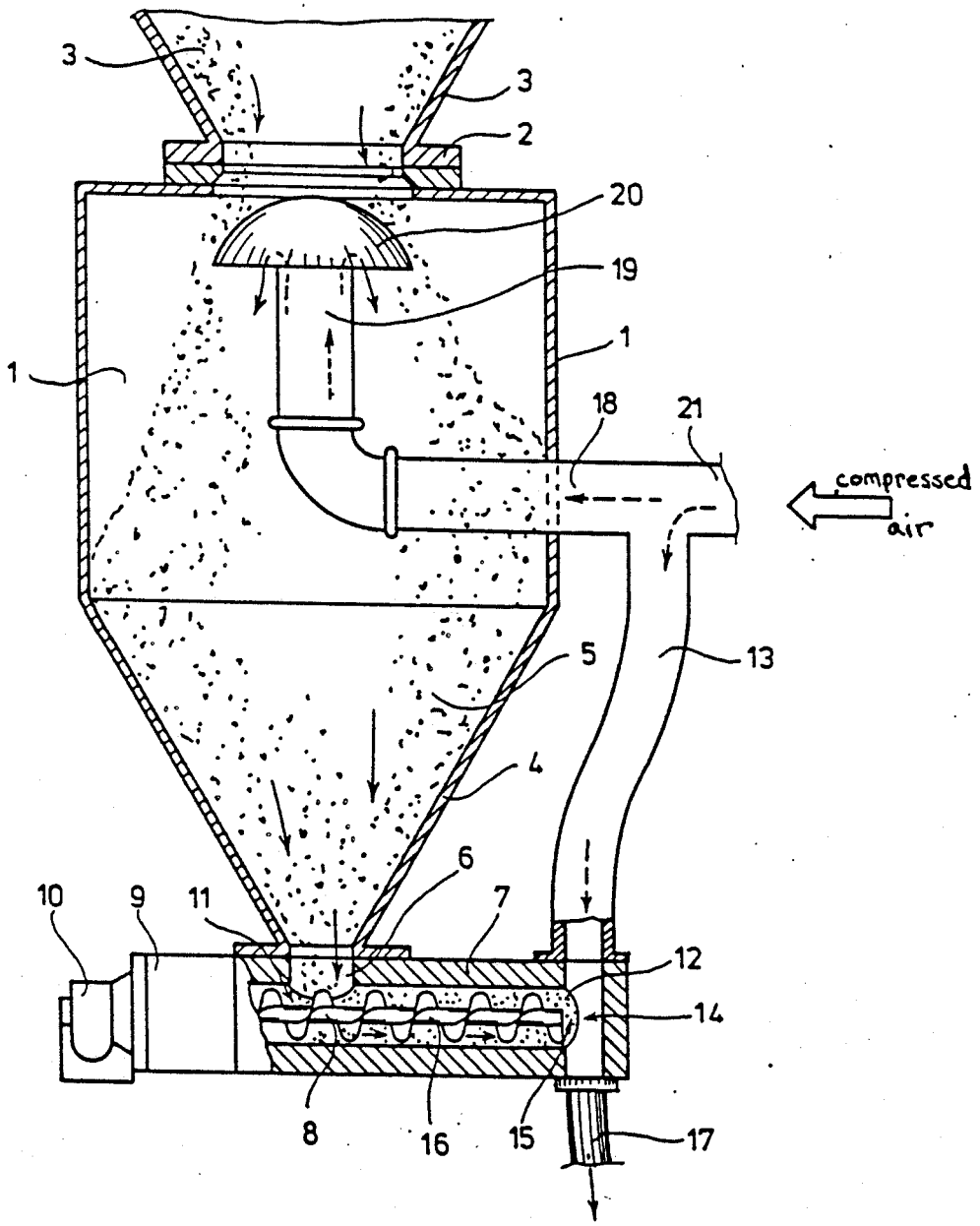
FIG. 1 diagrammatically illustrates a partial cross section of an embodiment of the inventive blasting apparatus, FIG. 2 diagrammatically illustrates a partial cross section of a second embodiment of the inventive blasting apparatus.

As illustrated in FIG. 1 blasting agent 5, which may be quartz sand, plastic granules, metal scrap or any such material known in the art, is stored in a closed pressure hopper 1. The hopper 1 may be opened and closed by means of a pressure cover 2. The open hopper is filled with a clean blasting agent 5 from a blasting agent feeder through an inlet 3. The blasting agent 5 collects in the funnel 4 located at the bottom of the hopper. The funnel 4 discharges the blasting agent 5 through a flow-thru connection 6 as is known in the art.

The blasting agent 5 must be fed by a feeder from the flow-thru connection 6 to a blast-air duct 13, and the blasting agent must be proportioned uniformly. For this purpose the blasting agent feed includes a conveyor screw 8 rotatably disposed in a screw conveyor tube 7, whose entry area 11 adjoins the flow-thru connection 6 and whose discharge area 15 terminates directly at the entrance to the blast-air duct 13. The conveyor screw 8 is a conventional transport screw having rolled surfaces welded to a shaft. The screw 8 may also be a wear-resistant cast screw made from chilled cast iron or be armored. The appropriate selection of the pitch, diameter and shape of the spiral to match the blasting agent is a matter of experience. For example, the delivery of 2.4 cubic meters of quartz sand per hour requires a screw diameter of 150 millimeters and a rotatory speed of 120 revolutions per minute. Another exemplary value for plastic granules with a delivery volume of about 10 cubic meters per hour is a screw diameter of 200 mm and rotatory speed of 110 revolutions/min.

The screw shaft 16 is cantilevered from a chuck and driven through a transmission 9 from a direct-current gear motor 10 at a continuously variable speed. The rate of delivery can be precisely adjusted through the rotatory speed. Preferably, the screw is driven in a medium speed range so that the adjustment of output can be made by increasing or by decreasing the rate of delivery.

The blast-air duct 13, which is operated at a pressure of about 6 bars from a compressed air connection 21, passes across the screw conveyor tube 7 in the form of a tee. The blast-air duct 13 continues without change in cross section across the screw conveyor tube. In the area of the cavity, i.e., in the work chamber of the conveyor screw 8, a circular opening is made into the blast-air duct, through which the uniformly fed blasting agent is admitted into the blast-air stream as the conveyor screw 8 rotates. The blast-air stream flows in the direction of the arrow and beyond the screw tube into a flexible hose 17 which is manipulated by an operator in a conventional and known manner.

The screw conveyor tube 7 is disposed horizontally relative to a vertical axis of the closed hopper 1. This position is preferable because the effects of gravity under certain circumstances may interfere with the precise feeding of the agent if the conveyor tube were sloped relative to the vertical axis of the hopper 1.

Furthermore, to render the blasting agent stream uniform, compensation for the pressure drop from the interior of the closed hopper 1 to the interior of the screw conveyor tube and all the way into the blast-air duct 13 is provided. For this purpose, a connecting duct 18 is provided between the blast-air duct 13 and the interior of the closed hopper 1, the branching of the connecting duct 18 to the blast-air line being upstream from the entry of the screw conveyor tube 7. The connecting duct 18 passes through an elbow joint into a vertical outlet section 19 on which a mushroom spreader 20 is placed. This spreader 20 not only prevents blasting agent 5 from dropping down into the connecting duct 18 but also provides for a better distribution of the blasting agent 5 within the closed hopper 1. By the measure described above, a uniform pressure is achieved within the entire hopper and feed system, so that the screw 8 does not have to feed the blasting agents either with or against a pressure drop, thereby achieving feeding uniformity.

In a second embodiment shown in FIG. 2, the blast air duct 13 forms a tee connection with the connecting duct 18 and the screw conveyor tube 7. The blast air duct 13 in FIG. 2 is also connected across the screw conveyor tube, as in FIG. 1.

Experiments conducted with the inventive apparatus have proven that the device has both uniform proportioning of blasting agent over long periods of time and that reliable reproduction of feed rates can be achieved.

It will be understood that the specification and drawing is illustrative but not limitative of the present invention and that other embodiments within the spirit and scope of the invention will suggest themselves to those skilled in the art.

I claim:

1. Apparatus for uniform dosing of granular blasting agents in pneumatically operating blasting machines, said apparatus comprising a substantially closed hopper having a top inlet with a closable orifice, a side inlet, and a bottom outlet;

a screw conveyor tube horizontally disposed below said hopper and having an entry area connected to the outlet of said hopper, said tube having opposed ends and a discharge area at an end remote from said entry area;

a screw conveyor disposed in said tube for moving said granular blasting agent from said entry area to said discharge area;

a blast air duct connected across said discharge area of said tube in a tee connection;

a connecting duct connecting said blast air duct to said side inlet of said hopper, and drive means for driving said screw conveyor at a continuously variable speed, said drive means being disposed at the end of said tube opposite said discharge area, whereby the air pressure in the screw conveyor and the blast air duct can be equalized so that constant and reproducible blasting agent flow rates are possible.

2. Apparatus as in claim 1 wherein said drive means comprises a D.C. motor.

3. Apparatus as in claim 2 wherein said motor is a D.C. gear motor.

4. Apparatus as in claim 1 wherein said drive means comprises a transmission and a D.C. gear motor, said transmission connecting said motor to said screw conveyor.

5. Apparatus as in claim 1 wherein said screw conveyor tube and said blast air duct have substantially the same cross-sectional area, thereby facilitating equalization of pressure therein.

6. Apparatus as in claim 1 wherein said connecting duct is connected to said blast air duct upstream of said discharge area of said conveyor tube.

7. Apparatus as in claim 1 wherein said connecting duct is connected to said blast air duct at said discharge area of said screw conveyor tube.

8. Apparatus as in claim 1 wherein said connecting duct comprises a vertical outlet section in said hopper, said apparatus further comprising a mushroom spreader in said hopper below said inlet, said spreader being connected to said outlet section to distribute said blasting agent downward uniformly in said hopper.

* * * * *